US010351395B2

(12) United States Patent
Roodenburg et al.

(10) Patent No.: US 10,351,395 B2
(45) Date of Patent: Jul. 16, 2019

(54) DAMPING DEVICE, DAMPING SYSTEM, VESSEL EQUIPPED WITH DAMPING SYSTEM AND DAMPING METHOD

(71) Applicant: ITREC B.V., Schiedam (NL)

(72) Inventors: Joop Roodenburg, Delft (NL); Wouter Gerard Leo Jinssen, Katwijk (NL)

(73) Assignee: ITREC B.V., Schiedam (NL)

( * ) Notice: Subject to any disclaimer, the term of this patent is extended or adjusted under 35 U.S.C. 154(b) by 96 days.

(21) Appl. No.: 15/118,544

(22) PCT Filed: Feb. 9, 2015

(86) PCT No.: PCT/NL2015/050081

§ 371 (c)(1),
(2) Date: Aug. 12, 2016

(87) PCT Pub. No.: WO2015/122764

PCT Pub. Date: Aug. 20, 2015

(65) Prior Publication Data

US 2017/0050823 A1 Feb. 23, 2017

(30) Foreign Application Priority Data

Feb. 13, 2014 (NL) ..... 2012258

(51) Int. Cl.
*B66C 23/52* (2006.01)
*B66C 13/06* (2006.01)
*B66C 23/53* (2006.01)

(52) U.S. Cl.
CPC ..... *B66C 13/06* (2013.01); *B66C 23/52* (2013.01); *B66C 23/53* (2013.01)

(58) Field of Classification Search
CPC ..... B66C 13/06; B66C 23/52
(Continued)

(56) References Cited

U.S. PATENT DOCUMENTS 5,480,041 A * 1/1996 Turner ..... B66C 23/06 212/273
6,039,193 A 3/2000 Naud et al.
(Continued)

FOREIGN PATENT DOCUMENTS

GB 2 252 295 A 8/1992
GB 2 456 626 A 7/2009
(Continued)

OTHER PUBLICATIONS

Bostelman et al., "Stability of an Underwater Work Platform Suspended From an Unstable Reference", Oceans '93. Engineering in Harmony With Ocean. Proceedings Victoria, BC, Canada, Oct. 18-21, 1993, New York, NY, USA, IEEE, Oct. 18, 1993, pp. II321-II325.

*Primary Examiner* — Jamel E Williams
(74) *Attorney, Agent, or Firm* — Birch, Stewart, Kolasch & Birch, LLP

(57) ABSTRACT

A damping device includes a cable to be connected to a mass; a winch for hauling in and paying out the cable; a measurement system for measuring a cable motion relative to the winch and for measuring a cable tension in the cable; a control system for damping cable motion by driving the winch in dependency of the measured cable motion and the measured cable tension; a sheave to guide the cable from the winch to the mass, wherein the measurement system is configured to measure the cable tension by measuring a magnitude of a load on the sheave caused by the cable tension.

17 Claims, 4 Drawing Sheets

(58) Field of Classification Search
USPC ..... 73/862.393
See application file for complete search history.

(56) References Cited

U.S. PATENT DOCUMENTS

| | | | | |
|---|---|---|---|---|
| 7,367,464 | B1 * | 5/2008 | Agostini | B66C 13/063 212/308 |
| 2011/0146556 | A1 * | 6/2011 | Yuan | B63B 39/005 114/121 |

FOREIGN PATENT DOCUMENTS

| | | | | |
|---|---|---|---|---|
| GB | 2456626 | A * | 7/2009 | B63B 27/08 |
| WO | WO 2005/090226 | A1 | 9/2005 | |
| WO | WO 2013/015684 | A1 | 1/2013 | |

* cited by examiner

DAMPING DEVICE, DAMPING SYSTEM, VESSEL EQUIPPED WITH DAMPING SYSTEM AND DAMPING METHOD

The invention relates to a damping device, in particular a damping device for offshore applications.

In offshore applications it is generally known that wind, waves and currents may hinder the execution of marine operations due to their negative impact on movement and/or stability of vessels and/or other equipment.

A clear example thereof is a situation in which a load is suspended from a crane on a vessel. Wind, waves and/or currents may exert forces on the vessel, which forces usually cause movement of the vessel resulting in a swinging load if no appropriate measures are taken. When e.g. the load needs to be positioned accurately relative to the vessel or another object, excessive swinging of the load may cause significant challenges or even make it impossible to do this, especially because the load may be relatively heavy which also increases the risk of serious damage to the load, vessel and/or other equipment when undesired collisions occur between the vessel or equipment thereon and the load as a result of the swinging load.

Hence, marine operations can only be carried out during specific combinations of (weather) conditions and it usually happens that one has to wait for the right combination of conditions before a marine operation can be carried out. It is therefore desirable to reduce the negative influence of the wind, waves and currents on the movement and/or stability of vessels and/or other equipment.

A possible solution is to damp motions caused by wind, water and/or currents, such that even at harsher conditions the motions stay below a predetermined amount still allowing to carry out the marine operations. Hence, by damping the motions the range of weather combinations allowing to carry out the marine operation is extended.

An example thereof is disclosed in international patent application published as WO2013/015684 A1 which discloses a damping device constructed and arranged for damping the movement of a vessel or of a mass, wherein the damping device comprises:

- a support structure constructed to be positioned on a vessel and configured for supporting the mass, the support structure being constructed to allow the mass to make a back and forth movement relative to said hull along a trajectory, between opposite ends of said trajectory,
- an energy dissipation device,
- a connection organ constructed to connect a support point on a hull of a vessel with a moveable mass.

Although this prior art solution may have advantages in some cases, damping is not always satisfactory. The object of the invention is therefore to provide an improved damping device.

In order to achieve this object a damping device according to claim 1 is provided. The damping device according to the invention is characterized in that a sheave is used to guide the cable from the winch to the mass and in that the measurement system is configured to measure the cable tension in the cable by measuring a magnitude of a load on the sheave caused by the cable tension.

An advantage of using a sheave between the winch and mass is that the sheave only interacts with the cable wound about at least a portion of the sheave, so that the loads applied to the sheave are the direct result of cable tension in the cable, where the cable tension in prior art devices is measured on the winch which is subject to a lot of disturbance forces resulting in inaccurate measurements of the cable tension. Hence, measuring the cable tension at the sheave results in a more accurately determined cable tension.

Another advantage may be that the position of the winch relative to the mass is no longer critical as the position of the sheave determines how the cable extends to the mass. This allows to position the winch at a more convenient location.

In an embodiment, the control system is configured to apply a desired cable tension by driving the winch based on the measured cable tension. This is usually carried out by the control system by comparing the measured cable tension with the desired cable tension and providing a drive signal to the winch in dependency of the difference between the measured and desired cable tension. The determination of the drive signal in dependency of the difference between the measured and desired cable tension can be carried out by an appropriate controller which may be of any form including a P, PI or PID controller as is generally known to a person skilled in the art of control systems. Other controller types are also envisaged.

In an embodiment, the control system comprises a damping mode in which the desired cable tension is dependent on the measured cable motion. Preferably, in damping mode, the desired cable tension in case the measured cable motion indicates that the cable is paid out by the winch is higher than in case the measured cable motion indicates that the cable is hauled in by the winch.

In an embodiment, the desired cable tension is independent of the cable speed, but only dependent on the direction of motion of the cable speed. An embodiment where the desired cable tension is dependent on cable speed as well also falls within the scope of this invention.

In an embodiment, the cable motion is measured by measuring the cable speed relative to the winch. Other measurement principle of measuring cable motion may also apply. A simple embodiment may for instance be formed by a pivotable member being in frictional contact with the cable which only indicates the direction of cable motion via its orientation resulting from the frictional forces applied to the member by the cable.

The cable motion can be measured directly by interaction of a sensor with the cable, but it is also possible to measure the cable motion indirectly. An embodiment of indirect measurement can be formed by measuring a motion of the sheave. An example thereof is to measure the motion of the sheave by measuring the rotational speed or position of the sheave, which rotational speed may be used as a signal being representative for the cable speed mentioned above.

In order to measure the cable motion, an appropriate sensor may be used, which sensor is then part of the measurement system. The sensor may be an encoder type sensor, but any other sensor type capable of measuring the same may be applied.

In an embodiment, the control system also comprises a non-damping mode in which the desired cable tension is independent of the measured cable motion, and wherein the control system is operable to switch between the damping mode and non-damping mode. Switching between the damping and non-damping mode may require input, e.g. from a user or operator, but may alternatively or additionally be carried out automatically based on predefined conditions.

The non-damping mode may for instance be used during start-up of the damping device to introduce tension in the cable. Once an initial cable tension is applied, the damping device may be switched to the damping mode.

In an embodiment, the control system may be configured to automatically switch from the damping mode to the non-damping mode when in the damping mode the measured cable tension drops below a predetermined minimum value.

The invention also relates to a damping system comprising a first damping system, which first damping system is embodied as a damping system according to the invention.

In an embodiment, the damping system further comprises a second damping system, which second damping system is embodied as a damping system according to the invention.

In an embodiment, the first and second damping devices of the damping system are damping devices of which the respective control systems are configured to apply a desired cable tension in the respective cable by driving the respective winch based on respective measured cable tension, and wherein the damping system further comprises a yaw control system configured to adapt the desired cable tensions in the cables of the first and second damping devices based on a difference between the measured cable motion of the cable of the first damping device and the measured cable motion of the cable of the second damping device in order to minimize said difference between the measured cable motions in the cables of the first and second damping device.

The yaw control system may therefore be configured to carry out the following steps:

a) to receive the measured cable motion of the cable of the first damping device;
b) to receive the measured cable motion of the cable of the second damping device;
c) to determine a difference between the received measured cable motions; and
d) to output a tension compensation value for each of the first and second damping device, The respective control systems of the first and second damping devices are then configured to receive the respective tension compensation value and to adapt the desired cable tension in accordance with the tension compensation value.

In an embodiment, the yaw control system outputs only a single tension compensation value which is added to the desired cable tension of one of the first and second damping device and is subtracted from the desired cable tension of the other one of the first and second damping device in order to counteract the difference in measured cable motions.

Alternatively, the yaw control system may output separate tension compensation values for the first and second damping device.

In an embodiment, the yaw control system is configured to not only minimize the difference between the measured cable motions in the cables of the first and second damping device, but to also position the mass in a predetermined angular orientation about a vertical axis. The yaw control system may deduct the angular orientation of the mass about the vertical axis from the measured cable motions, but alternatively or additionally, the angular orientation may be separately measured, e.g. by measuring the angular orientation of the winch or by directly measuring on the mass.

The invention further relates to a vessel comprising a damping system according to the invention.

The vessel may further include a mass, e.g. a reel, wherein the mass and the damping system are configured to be connected to each other via one or more cables of the damping system.

In an embodiment, the mass and the cables of the first and second damping device are configured to be connected to the mass at distinct locations which are at least spaced apart in horizontal direction.

In an embodiment, the vessel further comprises a crane including a hoisting cable to be connected to the mass in order to handle the mass.

The invention also relates to a method to damp motion of a moveable mass, said method comprising the following steps:

a) connecting a first cable to the mass, such that the first cable is guided from a first winch to the mass by a first sheave;
b) measuring cable motion of the first cable relative to the first winch;
c) measuring cable tension in the first cable by measuring a magnitude of a load on the first sheave caused by the cable tension; and
d) damping motion of the first cable by driving the first winch in dependency of the measured cable motion of the first cable and the measured cable tension in the first cable.

In an embodiment, damping motion of the first cable includes applying a desired cable tension in the first cable by driving the first winch based on the measured cable tension in the first cable, wherein preferably the desired cable tension is dependent on the measured cable motion of the first cable, and wherein preferably the desired cable tension is higher in case the first cable is paid out by the first winch than in case the first cable is hauled in by the first winch.

In an embodiment, the method further includes the following steps:

e) connecting a second cable to the mass, such that the second cable is guided from a second winch to the mass by a second sheave, and such that the first and second cable are connected to the mass at distinct location which are at least spaced apart in horizontal direction;
f) measuring cable motion of the second cable relative to the second winch;
g) measuring cable tension in the second cable by measuring a magnitude of a load on the second sheave caused by the cable tension; and
h) damping motion of the second cable by driving the second winch in dependency of the measured cable motion of the second cable and the measured cable tension in the second cable.

In an embodiment, damping motion of the second cable includes applying a desired cable tension in the second cable by driving the second winch based on the measured cable tension in the second cable, wherein preferably the desired cable tension is dependent on the measured cable motion of the second cable, and wherein preferably the desired cable tension is higher in case the second cable is paid out by the second winch than in case the second cable is hauled in by the second winch.

In an embodiment, the method also includes the following steps:

i) comparing the measured cable motion of the first cable with the measured cable motion of the second cable;
j) determining a difference between the measured cable motions of the first and second cable; and
k) adapting the desired cable tensions in the first and second cable based on the determined difference in order to minimize said difference.

The invention will now be described in a non-limiting way by reference to the accompanying drawings in which like parts are indicated by like reference symbols, and in which.

Figure 1:
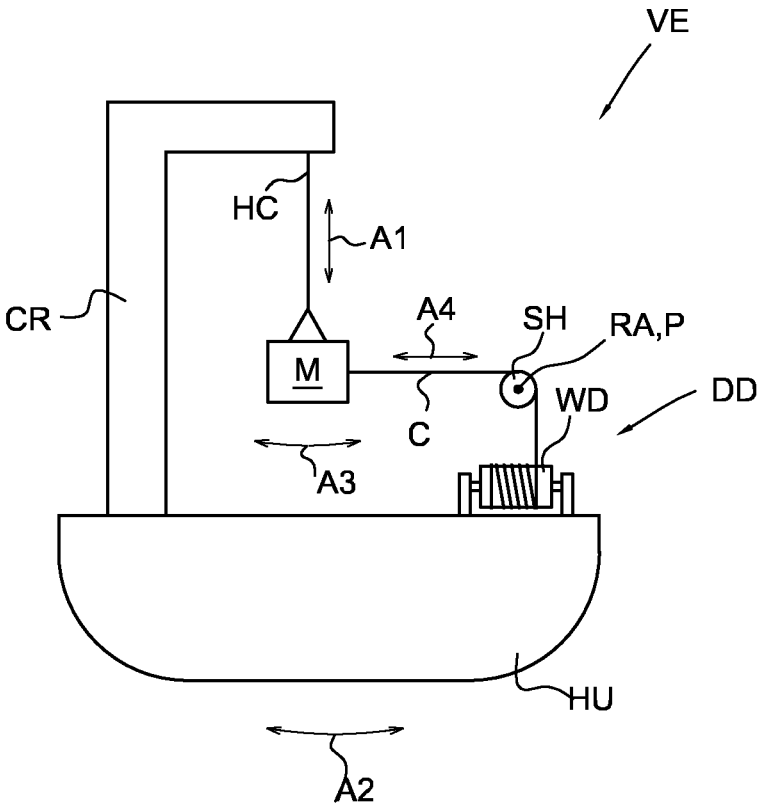
FIG. 1 depicts a vessel according to an embodiment of the invention.

FIG. 1 depicts schematically a vessel VE according to an embodiment of the invention. The vessel VE includes a hull HU and a crane CR arranged on the hull. The crane CR comprises a hoisting cable HC, which in the shown configuration, holds a mass M. Hauling in and paying out of the hoisting cable by an appropriate winch (not shown) allows to respectively lift and lower the mass M by the crane as indicated by arrow A1. As the operation of the crane is generally known and not relevant for describing the invention, the crane CR will not be described in more detail.

Movement of the vessel VE, as e.g. indicated by arrow A2, which may be caused by wind, waves and/or currents, may cause the mass M to swing relative to the crane CR and hull HU as indicated by arrow A3. In order to damp motion of the mass M relative to the vessel, a damping system including a damping device DD is provided on the vessel. The damping device DD is partially shown in FIG. 1, schematically in FIG. 2, and FIG. 3 depicts in more detail a part thereof.

The damping device DD comprises a cable C connected to the mass M. The cable C is wound on a winch drum WD which can be rotated by a motor MO connected thereto. The combination of winch drum WD and motor MO will be referred to as winch W. Rotation of the winch drum by the motor MO allows to haul in or pay out the cable C as indicated by arrow A4.

The cable C is guided by a sheave SH which is rotatable about a sheave rotation axis RA defined in this embodiment by a pin P and corresponding bearings (not shown). The sheave SH interacts with the cable C in such a manner that motion of the cable C will result in rotation of the sheave SH and tension in the cable C will result in loads applied to the sheave SH and thus to the pin P and bearings of the sheave SH.

Figure 2:
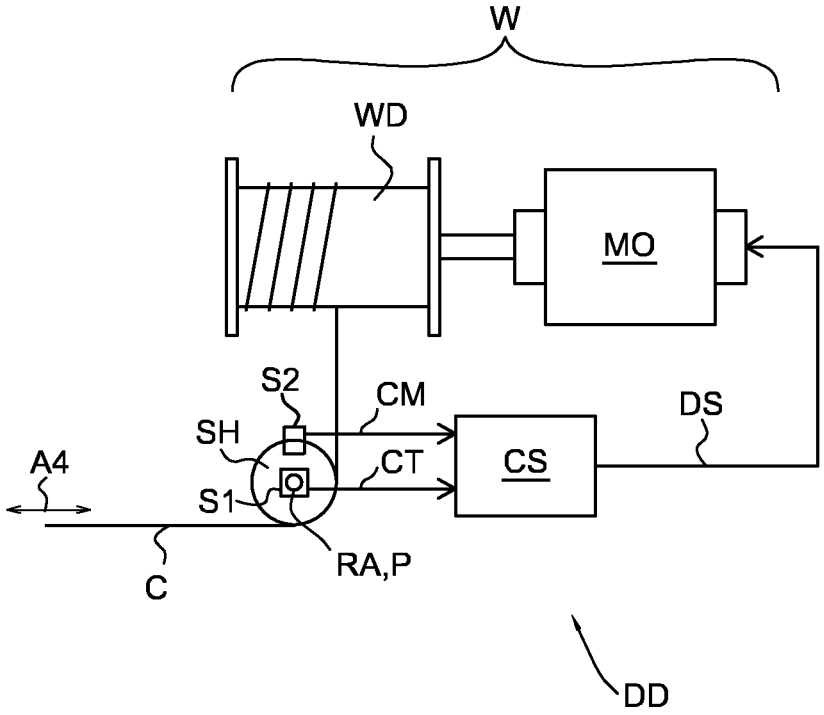
FIG. 2 depicts schematically a damping system provided on the vessel of FIG. 1.
Figure 3:
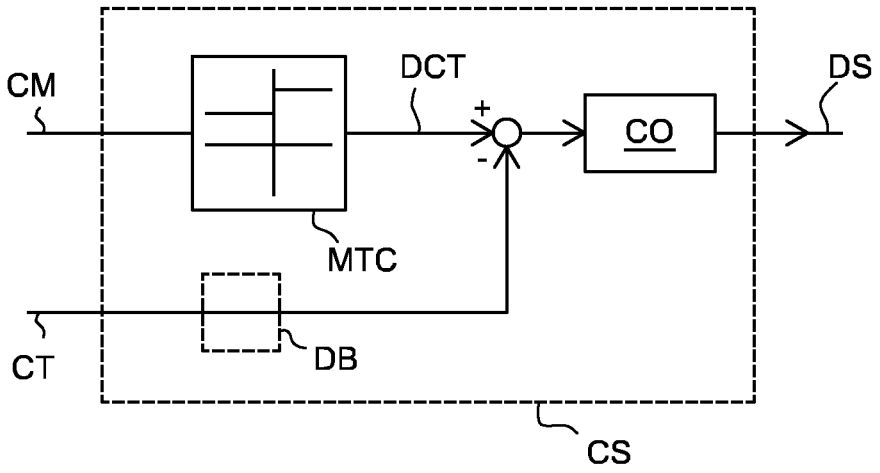
FIG. 3 depicts in more detail a control system for use in the damping system of FIG. 2.

The damping device DD according to the embodiment of FIGS. 1 and 2 comprises a measurement system for measuring a cable motion of the cable C relative to the winch and for measuring a cable tension in the cable C. In FIG. 2, the measurement system comprises a sensor S1 measuring the loads applied to the pin P, thereby measuring a magnitude of a load on the sheave SG caused by the cable tension allowing to determine the cable tension in the cable C.

Alternatively or additionally, the measurement system may comprise sensors measuring the cable tension more directly, e.g. by using strain gauges on the cable or on the part connecting the cable to the mass.

The measurement system further comprises a sensor S2 measuring motion of the sheave SH caused by motion of the cable C, for instance by measuring the rotational speed of the sheave SH, e.g. using an incremental encoder type of sensor.

The measured cable motion and the measured cable tension are input to a control system CS configured to drive the winch W in dependency of the measured cable motion and the measured cable tension in order to damp the cable motion. Driving the winch is carried out by providing a drive signal DS to the motor MO. Motor MO can e.g. be an electric motor, but can also be a hydraulic motor.

FIG. 3 depicts in more detail an embodiment of the control system CS of FIG. 2. Input to the control system are a signal CM representative for the cable motion of the cable C, and a signal CT representative for the cable tension in the cable C. The signal CM is converted into a desired cable tension DCT by a motion to tension converter MTC. The desired cable tension DCT is compared to the actually measured cable tension CT, and the difference between the two is fed to a controller CO which, based on the desired cable tension and the measured cable tension, outputs a drive signal DS to the motor MO of the winch in order to apply the desired cable tension in the cable C.

The signals inputted to the control system may in an embodiment be processed first by a processing unit. An example thereof is illustrated by a processing unit DB shown in dashed lines for processing the cable tension signal CT. A similar processing unit may be provided for the cable motion signal CM. The processing unit may amongst others filter and/or convert the signal into a signal suitable to be processed further by the control system.

The motion to tension converter MTC may be configured to output a desired cable tension DCT which is dependent on the measured cable motion. When the mass is moving towards the damping device, the desired cable tension may be lower than in case the mass is moving away from the damping device. In other words, the desired cable tension is higher in case the cable is paid out than in case the cable is hauled in. A minimum cable tension is preferably always desired as this prevents a slack cable.

The above configuration of the control system may be referred to as damping mode. However, the control system may also comprise a non-damping mode. In this non-damping mode, the desired cable tension is constant and thus independent of the cable motion. The non-damping mode may be implemented in the motion to tension converter which in the damping mode operates as described above, but in the non-damping mode is set to output a constant desired tension independent of the input to the motion to tension converter MTC.

Figure 4:
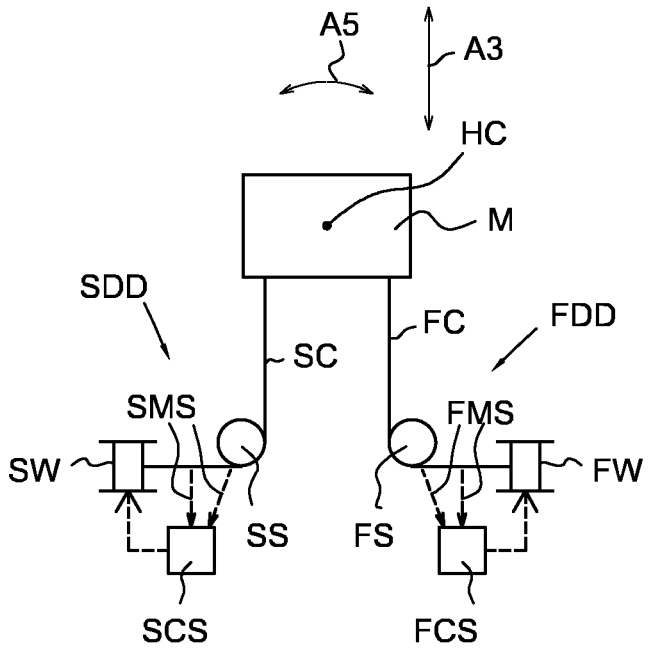
FIG. 4 depicts a top view of a vessel according to another embodiment of the invention.

FIG. 4 depicts a top view of a part of a vessel according to another embodiment of the invention. Shown are a mass M which is suspended from a hoisting cable HC as in FIG. 1. Due to vessel motions, e.g. roll of the vessel, the mass may start to swing back and forth as indicated by arrow A3. However, it is also possible that the mass M starts to rotate about a vertical axis parallel to the hoisting cable as indicated by arrow A5. For instance due to yaw of the vessel. In order to damp motions of the mass M, a damping system is provided comprising a first damping device FDD and a second damping device SDD.

The first and second damping device are both a damping device similar to the damping device shown in relation to FIGS. 1-3. Hence, the first damping device comprises a first cable FC connected to a first winch FW and guided from the first winch to the mass by a first sheave FS. The second damping device in turn comprises a second cable SC connected to a second winch SW and guided from the second winch to the mass by a second sheave SS.

The first damping device further comprises a first measurement system FMS for measuring a cable motion of the first cable FC relative to the first winch FW and for measuring a cable tension in the first cable, and a first control system FCS for damping cable motion of the first cable FC by driving the first winch in dependency of the measured cable motion of the first cable and the measured cable tension in the first cable.

The second damping device further comprises a second measurement system SMS for measuring a cable motion of the second cable SC relative to the second winch SW and for measuring a cable tension in the second cable, and a second control system SCS for damping cable motion of the second cable SC by driving the second winch in dependency of the measured cable motion of the second cable and the measured cable tension in the second cable.

Figure 5:
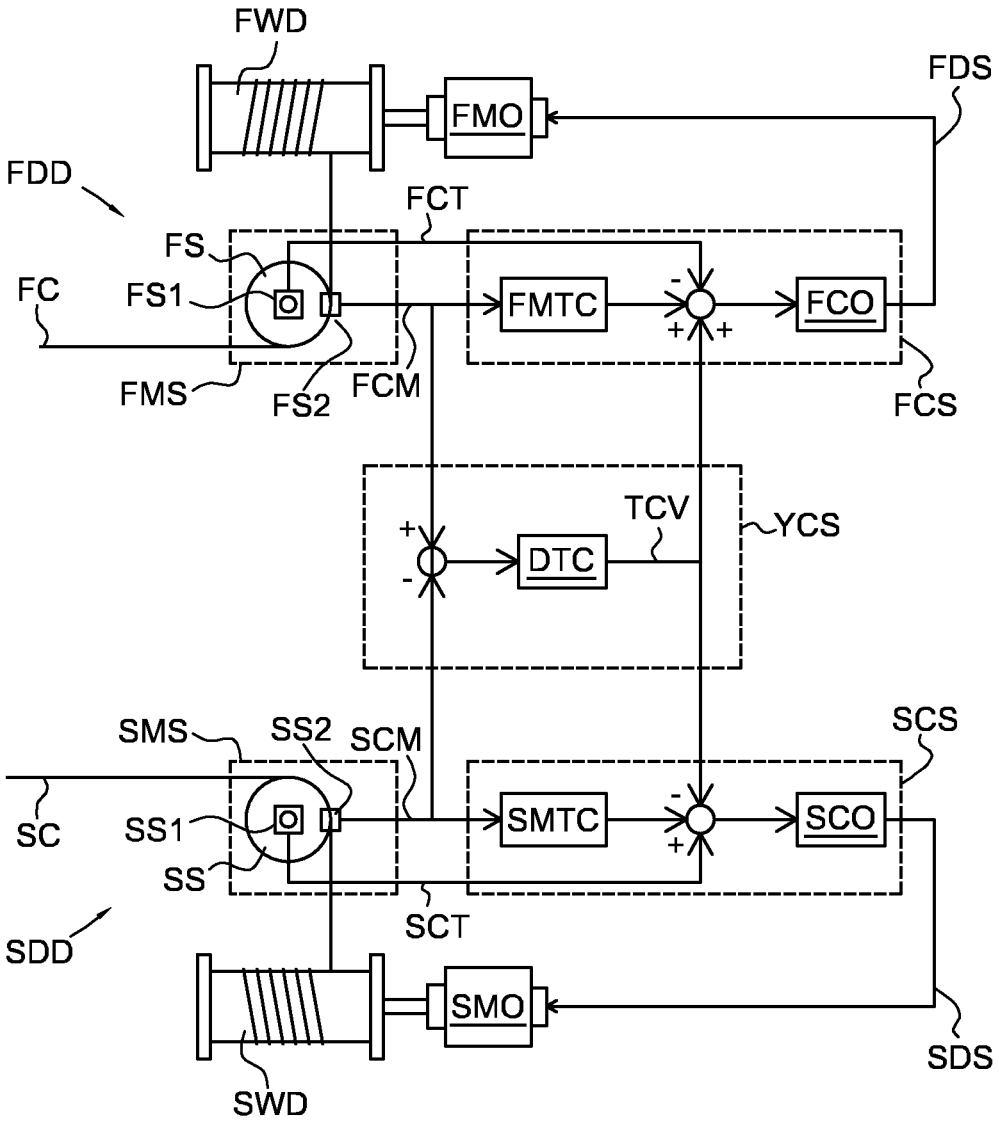
FIG. 5 depicts schematically a damping system provided on the vessel of FIG. 4.

The first and second control system FCS, SCS are interconnected via a yaw control system as is shown in FIG. 5, but omitted in FIG. 4 for clarity reasons.

FIG. 5 depicts in more detail the damping system of FIG. 4. The first damping device of the damping system includes a first winch with a first winch drum FWD which is driven by a first motor FMO. Also shown are the first sheave FS guiding the first cable FC from the first winch to the mass. Similarly, the second damping device of the damping system includes a second winch with a second winch drum SWD which is driven by a second motor SMO. Also shown are the second sheave SS guiding the second cable SC from the second winch to the mass.

The first damping device FDD further comprises a first measurement system FMS including a first tension sensor FS1 for measuring a magnitude of the loads applied to the first sheave FS to determine the cable tension in the first cable FC, and including a first motion sensor FS2 for measuring a motion of the first cable FC.

The second damping device further comprises a second measurement system SMS including a second tension sensor SS1 for measuring a magnitude of the loads applied to the second sheave SS to determine the cable tension in the second cable SC, and including a second motion sensor SS2 for measuring a motion of the second cable SC.

The signal FCM representative for the motion of the first cable is inputted to a first motion to tension converter FMTC of a first control system FCS to provide a desired cable tension for the first cable which is dependent on the measured cable motion of the first cable, and is inputted to a yaw control system YCS.

The signal SCM representative for the motion of the second cable is inputted to a second motion to tension converter SMTC of a second control system SCS to provide a desired cable tension for the second cable which is dependent on the measured cable motion of the second cable, and is inputted to the yaw control system YCS.

The yaw control system YCS compares the measured cable motion of the first cable with the measured cable motion of the second cable. The difference between said two measured cable motions is representative for motion of the mass about the hoisting cable indicated by arrow A5 in FIG. 4.

The yaw control system YCS comprises a difference to tension converter DTC to determine a tension compensation value TCV that is added to the desired cable tension in the first control system and subtracted from the desired cable tension in the second control system.

In both control systems FCS, SCS the adapted desired cable tension is compared to the measured cable tension, and the difference therebetween is inputted to a respective controller FCO and SCO which provides a respective drive signal FDS and SDS to the corresponding motors FMO and SMO of the winches FW and SW.

Hence, when there is a difference between the cable motions of the first and second cable, the desired cable tensions as applied by the first and second control system are different and counteract the difference between the cable motions of the first and second cable thereby damping the rotation of the mass M about the hoisting cable HC.

It will be apparent to the skilled person in the art of damping systems that the invention is not limited to the examples shown above and that many other embodiments and alternatives also fall within the scope of the invention.

The invention claimed is:

1. A damping device, comprising:

a cable to be connected to a mass;

a winch for hauling in and paying out the cable;

a measurement system for measuring a cable motion relative to the winch and for measuring a cable tension in the cable;

a control system for damping cable motion by driving the winch in dependency of the measured cable motion and the measured cable tension; and a sheave to guide the cable from the winch to the mass, wherein the measurement system is configured to measure the cable tension by measuring a magnitude of a load on the sheave caused by the cable tension, wherein the control system comprises a damping mode in which a desired cable tension applied in the cable by the control system is dependent on the measured cable motion, and wherein the control system also comprises a non-damping mode in which the desired cable tension is independent of the measured cable motion, and wherein the control system is operable to switch between the damping mode and the non-damping mode.

2. The damping device according to claim 1, wherein the control system is configured to apply the desired cable tension in the cable by driving the winch based on the measured cable tension.

3. The damping device according to claim 1, wherein in the damping mode of the control system, the control system is configured such that, in case the cable is paid out by the winch, the desired cable tension in the cable is higher than in case the cable is hauled in by the winch.

4. The damping device according to claim 1, wherein the measurement system is configured to measure the cable motion relative to the winch by measuring the cable speed.

5. The damping device according to claim 1, wherein the measurement system is configured to measure the cable motion relative to the winch by measuring motion of the sheave caused by the cable motion.

6. The damping device according to claim 5, wherein the measurement system is configured to measure the motion of the sheave by measuring a rotational speed of the sheave.

7. The damping device according to claim 5, wherein the measurement system comprises a sensor to measure the motion of the sheave, which sensor is an encoder type sensor.

8. The damping device according to claim 1, wherein the control system in the damping mode is configured to automatically switch to the non-damping mode when the cable tension drops below a predetermined minimum value.

9. A damping system comprising:

a first damping device; and a second damping device, wherein each of the first damping device and the second damping device comprises:

a cable to be connected to a mass;

a winch for hauling in and paying out the cable;

a measurement system for measuring a cable motion relative to the winch and for measuring a cable tension in the cable;

a control system for damping cable motion by driving the winch in dependency of the measured cable motion and the measured cable tension; and a sheave to guide the cable from the winch to the mass, wherein the measurement system is configured to measure the cable tension by measuring a magnitude of a load on the sheave caused by the cable tension, and wherein the control system is configured to apply a desired cable tension in the cable by driving the winch based on the measured cable tension, and wherein the damping system further comprises a yaw control system configured to adapt the desired cable tension in the cables of the first and second damping devices based on a difference between the measured cable motion of the cable of the first damping device and the measured cable motion of the cable of the second damping device in order to minimize said difference between the measured cable motion in the cables of the first and second damping devices.

10. A vessel comprising the damping system according to claim 9.

11. The vessel according to claim 10, further including a mass, wherein the mass and the damping system are configured to be connected to each other via one or more cables of the damping system.

12. The vessel according to claim 11, wherein the mass and the cables of the first and second damping device are configured to be connected to the mass at distinct locations which are at least spaced apart in horizontal direction.

13. The vessel according to claim 10, wherein the vessel further comprises a crane including a hoisting cable to be connected to the mass in order to handle the mass.

14. A method to damp motion of a moveable mass, said method comprising the following steps:

connecting a first cable to the mass, such that the first cable is guided from a first winch to the mass by a first sheave;

connecting a second cable to the mass, such that the second cable is guided from a second winch to the mass by a second sheave, and such that the first and second cable are connected to the mass at distinct locations which are at least spaced apart in horizontal direction;

measuring cable motion of the first cable relative to the first winch;

measuring cable motion of the second cable relative to the second winch;

measuring cable tension in the first cable by measuring a magnitude of a load on the first sheave caused by the cable tension;

measuring cable tension in the second cable by measuring a magnitude of a load on the second sheave caused by the cable tension;

damping motion of the first cable by driving the first winch in dependency of the measured cable motion of the first cable and the measured cable tension in the first cable; and damping motion of the second cable by driving the second winch in dependency of the measured cable motion of the second cable and the measured cable tension in the second cable.

15. The method according to claim 14, wherein the step of damping motion of the first cable includes applying a desired cable tension in the first cable by driving the first winch based on the measured cable tension in the first cable, wherein the desired cable tension is dependent on the measured cable motion of the first cable, and wherein the desired cable tension is higher in case the first cable is paid out by the first winch than in case the first cable is hauled in by the first winch.

16. The method according to claim 15, wherein the step of damping motion of the second cable includes applying a desired cable tension in the second cable by driving the second winch based on the measured cable tension in the second cable, wherein the desired cable tension is dependent on the measured cable motion of the second cable, and wherein the desired cable tension is higher in case the second cable is paid out by the second winch than in case the second cable is hauled in by the second winch.

17. The method according to claim 16, wherein the method also includes the following steps:

comparing the measured cable motion of the first cable with the measured cable motion of the second cable;

determining a difference between the measured cable motions of the first and second cable;

adapting the desired cable tensions in the first and second cable based on the determined difference in order to minimize said difference.

* * * * *